US012137784B2

(12) United States Patent
Chen

(10) Patent No.: US 12,137,784 B2
(45) Date of Patent: Nov. 12, 2024

(54) AMPLIFICATION TYPE HAIR DRYER

(71) Applicant: Guangdong Wuye Technology Co., Ltd., Dongguan (CN)

(72) Inventor: Yiyang Chen, Dongguan (CN)

(73) Assignee: Guangdong Wuye Technology Co., Ltd., Guangdong (CN)

( * ) Notice: Subject to any disclaimer, the term of this patent is extended or adjusted under 35 U.S.C. 154(b) by 550 days.

(21) Appl. No.: 17/426,089

(22) PCT Filed: Dec. 18, 2020

(86) PCT No.: PCT/CN2020/137645
§ 371 (c)(1),
(2) Date: Jul. 27, 2021

(87) PCT Pub. No.: WO2021/196756
PCT Pub. Date: Oct. 7, 2021

(65) Prior Publication Data

US 2022/0312925 A1 Oct. 6, 2022

(30) Foreign Application Priority Data

Apr. 3, 2020 (CN) ..... 202010259406.7

(51) Int. Cl.
*A45D 20/12* (2006.01)

(52) U.S. Cl.
CPC ..... *A45D 20/12* (2013.01); *A45D 2020/128* (2013.01)

(58) Field of Classification Search
CPC ..... A45D 20/12; A45D 2020/128
(Continued)

(56) References Cited

U.S. PATENT DOCUMENTS 1,669,569 A * 5/1928 Meyer ..... A45D 20/14 392/428
2,503,113 A * 4/1950 Hribar ..... A45D 20/44 34/80

(Continued)

FOREIGN PATENT DOCUMENTS

CN 111336123 A * 6/2020 ..... A45D 20/12
WO WO-2018029531 A2 * 2/2018 ..... A45D 20/12
WO WO-2021196756 A1 * 10/2021 ..... A45D 20/12

*Primary Examiner* — Stephen M Gravini
(74) *Attorney, Agent, or Firm* — HOUTTEMAN LAW LLC

(57) ABSTRACT

The invention discloses an air amplification type hair dryer. The air amplification type hair dryer comprises a handle, an outer cylinder, an inner cylinder, a fan and a control circuit; the fan is installed in an air duct of the handle, an annular cavity connected with a ventilation duct is formed between the outer cylinder and the inner cylinder, an annular nozzle is formed at the front end of the annular cavity, the control circuit is contained in the tail section of the annular cavity, and a transverse tunnel-shaped hole is formed in the tail section of the handle to serve as an air inlet, so that a direct transmission channel of fan noise is blocked, and the noise can be reduced to a certain extent; the fan is sleeved with a silencing barrel, the air inlet section of the silencing barrel is arranged to be in a step shape to be shrunk, and the step can prevent part of noise from being transmitted outwards from the source of the fan; inclined spray holes are formed in the inner cylinder so that the flow speed of airflow sucked into the inner cylinder can be further increased, and the air volume is increased; and the outlet section of the inner cylinder is horn-mouth-shaped, so that on one hand, an expansion channel can be provided for airflow entering from the inclined spray holes, and on the other hand, the angle of the wind beam can be enlarged, and the blowing range of the wind beam is enlarged.

6 Claims, 3 Drawing Sheets

(58) Field of Classification Search
USPC ..... 34/95–100
See application file for complete search history.

(56) References Cited

U.S. PATENT DOCUMENTS

| | | | | | |
|---|---|---|---|---|---|
| 3,006,079 | A * | 10/1961 | Jepson | A45D 20/18 | 285/136.1 |
| 4,977,690 | A * | 12/1990 | Davis, Jr. | F26B 21/001 | 34/100 |
| 5,568,691 | A * | 10/1996 | Rubin | A45D 20/30 | 392/380 |
| 6,212,790 | B1 * | 4/2001 | Stetson | A45D 20/12 | 34/103 |
| 9,693,616 | B2 * | 7/2017 | Sakuma | A45D 20/12 | |
| 11,622,611 | B2 * | 4/2023 | Depoyian | A45D 20/12 | 34/97 |
| D1,000,701 | S * | 10/2023 | Chen | D28/13 | |
| 2017/0105502 | A1 * | 4/2017 | Maddocks | A45D 20/10 | |
| 2018/0042356 | A1 * | 2/2018 | Pavis | A45D 20/12 | |
| 2021/0219694 | A1 * | 7/2021 | Zhou | G06T 7/90 | |
| 2022/0312925 | A1 * | 10/2022 | Chen | A45D 20/12 | |

* cited by examiner

AMPLIFICATION TYPE HAIR DRYER

FIELD

The disclosure relates to a technical field of hair dryer, in particular to an air amplification type hair dryer.

BACKGROUND

The air amplification type hair dryer is mainly composed of a handle, an outer cylinder, an inner cylinder, a fan and a control circuit. The handle has an inner cavity as an air duct, and the fan is installed in the air duct of the handle. The outer cylinder and the inner cylinder constitute an air amplifier, an annular cavity communicating with the air passage is formed between the outer cylinder and the inner cylinder, the front end of the annular cavity forms an annular nozzle, and the control circuit is housed in the end section of the annular cavity. If there is a hot air function, electric heating elements are installed in the annular cavity. There is an air inlet at the end of the handle. The air is sucked into the air duct of the handle by the fan, forming a high-speed airflow into the annular duct of the air amplifier, and finally ejected from the annular nozzle. The jetted high-speed annular air flow forms a negative pressure zone in the inner cylinder, so that a large amount of air surrounding the inner cylinder will be sucked into the inner cylinder, and the air and the high-speed annular air flow merge into a high-speed, high-flow airflow and blow out from the air amplifier. The current air amplification type hair dryer is still a new product, and there is a lot of room for improvement in terms of noise, wind blowing range, and amplified air volume.

SUMMARY

The technical problem to be solved by the present invention is to provide an air amplification type hair dryer that can reduce noise, expand the blowing range of the wind, and increase the air volume.

The technical solution adopted to solve the above technical problems is that: an air amplification type hair dryer, including a handle, an outer cylinder, an inner cylinder, a fan, and a control circuit. The fan is installed in the air duct of the handle, and an annular cavity connected with a ventilation duct is formed between the outer cylinder and the inner cylinder. An annular nozzle is formed at the front end of the annular cavity, and the control circuit is housed in the end section of the annular cavity. It is characterized in that: a transverse tunnel-shaped hole is provided in the end section of the handle, and the peripheral wall of the tunnel-shaped hole is set to a grid shape. The fan is sleeved in a silencing barrel, and the air inlet section of the silencing barrel shrinks in steps. The inner cylinder is provided with a number of circumferentially arranged spray holes inclined towards the air outlet at the middle section, and the section of the inner cylinder from the spray hole to the outlet is set into a slightly expanded funnel-shaped.

Based on the above, a filter screen is installed on the surface of the tunnel-shaped hole located in the air duct of the handle.

Based on the above, the outer cylinder is formed with a baffle which isolates the control circuit from the annular cavity and the air duct of the handle.

Based on the above, the fan is sleeved in a rubber sleeve.

The beneficial effects of the present invention are that: because the air amplification type hair dryer of the present invention is provided with a transverse tunnel-shaped hole in the handle as the air inlet, the direct transmission channel of fan noise is blocked, and the noise can be reduced to a certain extent; and the fan is sleeved in the silencing barrel, and the air inlet section of the silencing barrel is set to shrink in a step shape, and the step can block a part of the noise from the source of the fan. The oblique spray holes opened on the inner cylinder can further enhance the flow rate of the air drawn into the inner cylinder, thereby increasing the air volume; and the outlet section of the inner cylinder is set into a funnel-shaped, on the one hand, it can provide expansion channel for the airflow entering from the oblique spray holes, on the other hand, it can expand the angle of the wind, thereby expanding the range of the wind.

DETAILED DESCRIPTION

Figure 1:
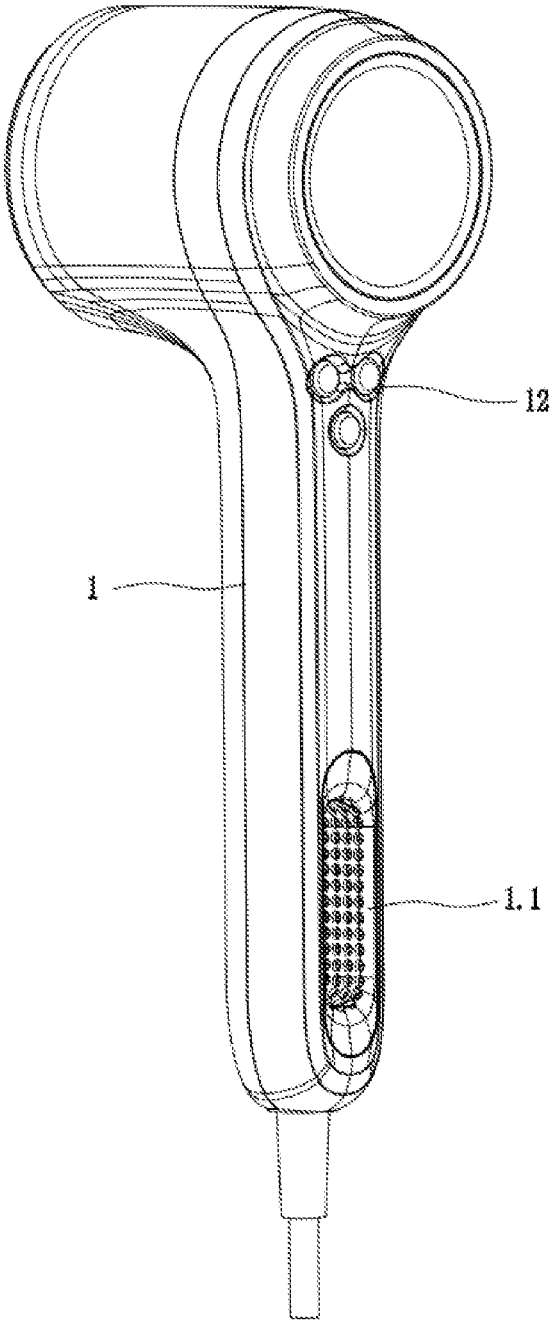
FIG. 1 is a schematic view of the structure of the air amplification type hair dryer of the present invention.
Figure 2:
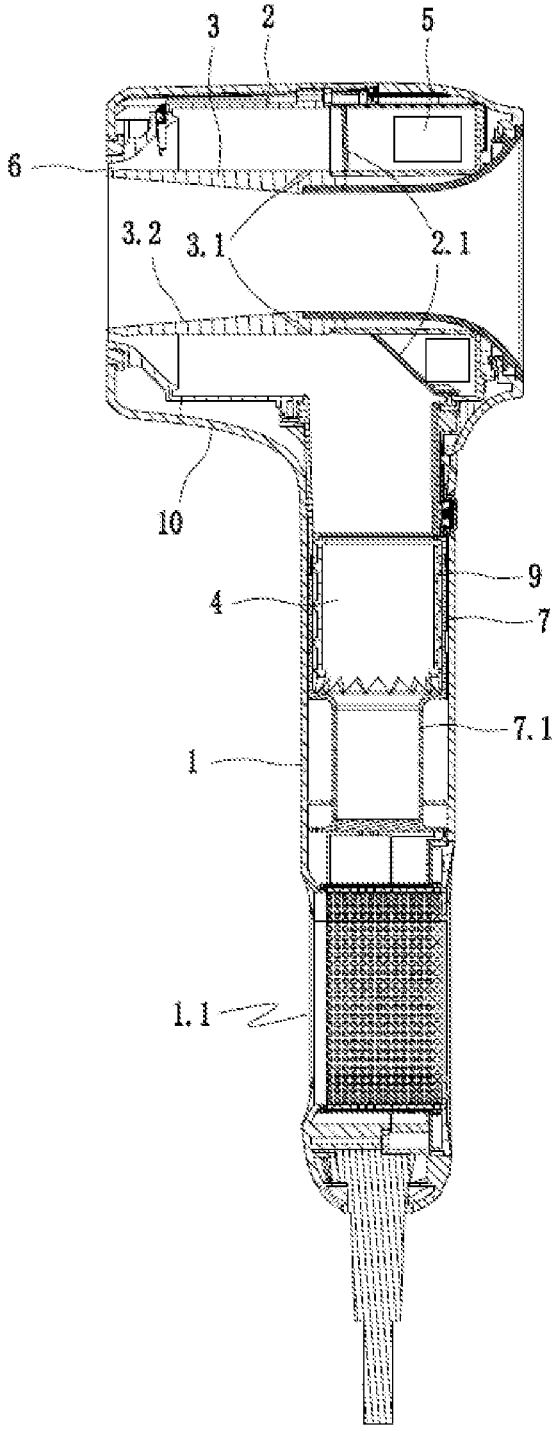
FIG. 2 is a sectional view of the air amplification type hair dryer of the present invention.
Figure 3:
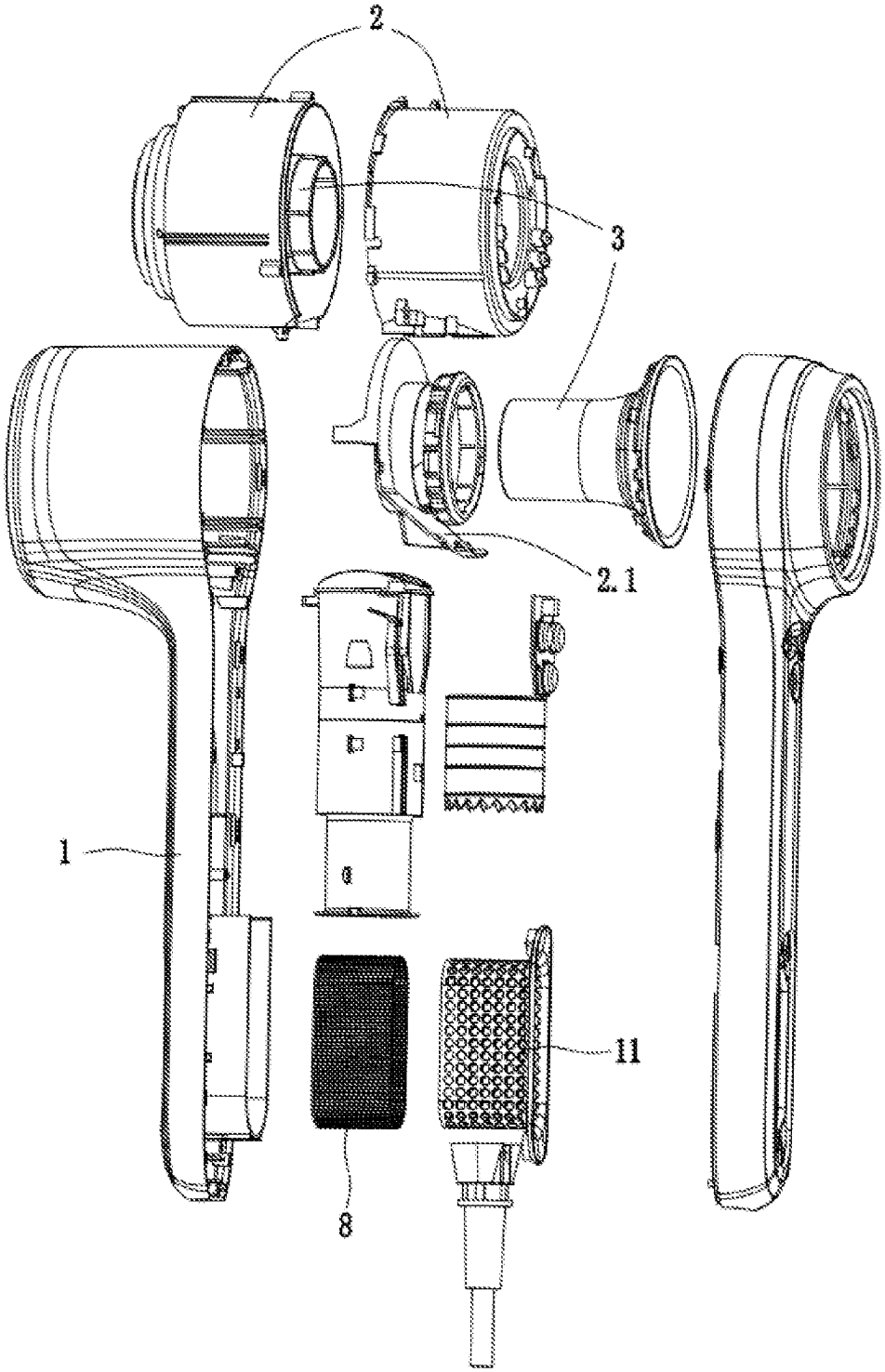
FIG. 3 is an exploded view of the air amplification type hair dryer of the present invention.

As shown in FIGS. 1-3, an air amplification type hair dryer includes a handle 1, an outer cylinder 2, an inner cylinder 3, a fan 4, and a control circuit 5 (the fan 4 and the control circuit 5 are conventional components, as shown in the figure It is the installation position, and its specific shape is not indicated), the fan 4 is installed in the air duct of the handle 1, an annular cavity connecting the air duct is formed between the outer cylinder 2 and the inner cylinder 3, and the front end of the annular cavity forms an annular nozzle 6, and the control circuit 5 is housed at the end of the annular cavity. In the present invention, a transverse tunnel-shaped hole 1.1 is provided in the end section of the handle 1, and the peripheral wall of the tunnel-shaped hole 1.1 is set to a grid shape. The fan 4 is sleeved in a silencing barrel 7, and the air inlet section 7.1 of the silencing barrel shrinks in steps. The inner cylinder 3 is provided with a number of circumferentially arranged spray holes 3.1 inclined towards the air outlet at the middle section, and the section of the inner cylinder 3 from the spray hole 3.1 to the outlet is set into a slightly expanded funnel-shaped.

The air is sucked into the air duct of the handle 1 from the transverse tunnel-shaped hole 1.1 by the fan 4, which forming a high-speed airflow into the annular cavity between the outer cylinder 2 and the inner cylinder 3, and finally ejects from the annular nozzle 6. The jetted high-speed annular air flow forms a negative pressure zone in the inner cylinder 3, so that a large amount of surrounding the inner cylinder 3 will be sucked into the inner cylinder 3, and the air and the high-speed annular air flow merge into a high-speed, high-flow airflow and blow out from the air amplifier. The transverse tunnel-shaped hole 1.1 is used as the air inlet of the handle 1, the direct transmission channel of fan noise is blocked, and the noise can be reduced to a certain extent; and the fan 4 is sleeved in the silencing barrel 7, and the air inlet section 7.1 of the silencing barrel 7 is set to shrink in a step shape, and the step can block a part of the noise from the source of the fan 4, thereby further reduce noise. The oblique spray holes 3.1 opened on the inner cylinder 3 can further enhance the flow rate of the air drawn into the inner cylinder 3, thereby increasing the air volume; and the outlet section 3.2 of the inner cylinder 3 is set into a funnel-shaped, on the one hand, it can provide expansion channel for the airflow entering from the oblique spray holes 3.1, on the other hand, it can expand the angle of the wind, thereby expanding the range of the wind.

In order to prevent finer foreign matter from being sucked into the fan, a filter screen 8 is installed on the surface of the tunnel-shaped hole 1.1 located in the air duct of the handle 1. In order to make the air flow in the fan flow more smoothly, the outer cylinder 2 is formed with a baffle 2.1 that isolates the control circuit 5 from the annular cavity and the handle air duct. In order to further reduce the vibration and noise of the fan, the fan 4 is sleeved in a rubber sleeve 9, for example, a silicone sleeve can be used.

As for the structural form of the various parts of the hair dryer, it can be specifically designed according to the functional structure of the machine to facilitate forming, processing and assembly, which is not the improvement and innovation of the present invention. In the present embodiment, the main body housing 10 and the handle 1 are a conjoined structure, and the conjoined structure is divided into front and rear parts along the longitudinal section of the handle 1 and the transverse section of the main body housing 10 to facilitate the assembly of other internal components. The tunnel-shaped hole 1.1 is set as an independent waist-shaped hole sleeve 11, a mesh is arranged on the peripheral wall, and the filter screen 8 is sleeved on the outer wall of the hole sleeve 11. The silencing barrel 7 can be designed into upper and lower parts to facilitate the installation of the fan 4. The outer cylinder 2 and the inner cylinder 3 are divided into front and rear parts. The front part of the outer cylinder 2 and the front part of the inner cylinder 3 are integrally formed to form the annular nozzle 6 and the air duct part of the annular cavity. The rear part of the outer cylinder 2 is formed independently, and form a annular cavity containing the control circuit 5. The rear part of the inner cylinder 3 is formed independently and is embedded in the cavity of the rear outer cylinder 2. The baffle 2.1 is formed independently and is assembled between the front and rear parts of the outer cylinder 2 to separate the annular cavity of the air duct part and the annular cavity of the part containing the control circuit 5. The control button panel 12 can be installed on the top of the handle 1 for easy operation.

What is claimed is:

1. An air amplification type hair dryer, comprising:

a handle having an upper end portion and a lower end portion opposite to the upper end portion, an air duct being form inside the handle, wherein the handle defines a longitudinal direction along the upper end portion and the lower end portion;

a main body housing;

an outer cylinder;

an inner cylinder;

a fan; and a control circuit;

wherein the upper end portion of the handle is connected to the main body housing, the fan is installed in the air duct of the handle at the lower end portion of the handle, the outer cylinder and the inner cylinder are arranged in the main body housing, the outer cylinder and the inner cylinder each have a front opening for air outlet, the outer cylinder surrounds the inner cylinder and thus an annular cavity is formed between the outer cylinder and the inner cylinder, the annular cavity is connected to the air duct of the handle, an annular nozzle is formed at a front end portion of the annular cavity, and the control circuit is housed in a rear end portion of the main body housing;

wherein a transverse tunnel-shaped hole is formed in the lower end portion of the handle transversely relative to the longitudinal direction of the handle, the transverse tunnel-shaped hole is formed below the fan, and a peripheral wall of the transverse tunnel-shaped hole is of a grid shape;

wherein the fan is sleeved in a barrel, and the barrel has an air inlet section connected to the transverse tunnel-shaped hole, the air inlet section has a diameter smaller than a diameter of the barrel;

wherein a plurality of spray holes are formed circumferentially on the inner cylinder, the plurality of spray holes are inclined towards the front opening of the inner cylinder, and a section of the inner cylinder from the plurality of spray holes to the front opening of the inner cylinder is expanded funnel-shaped.

2. The air amplification type hair dryer of claim 1, wherein a filter screen is installed on the peripheral wall of the transverse tunnel-shaped hole.

3. The air amplification type hair dryer of claim 1, wherein a baffle is formed on the outer cylinder to isolate the control circuit from the annular cavity and the air duct of the handle.

4. The air amplification type hair dryer of 1, wherein the fan is sleeved in a rubber sleeve, and the fan with the rubber sleeve is further sleeved in the barrel.

5. The air amplification type hair dryer of claim 2, wherein the fan is sleeved in a rubber sleeve, and the fan with the rubber sleeve is further sleeved in the barrel.

6. The air amplification type hair dryer of claim 3, wherein the fan is sleeved in a rubber sleeve, and the fan with the rubber sleeve is further sleeved in the barrel.

* * * * *